US006970152B1

(12) United States Patent
Bell et al.

(10) Patent No.: US 6,970,152 B1
(45) Date of Patent: Nov. 29, 2005

(54) STACKED AMPLIFIER ARRANGEMENT FOR GRAPHICS DISPLAYS

(75) Inventors: Marshall J. Bell, Chandler, AZ (US); Christopher A. Ludden, Pittsford, NY (US); Richard Alexander Erhart, Tempe, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 173 days.

(21) Appl. No.: 10/287,900

(22) Filed: Nov. 5, 2002

(51) Int. Cl.[7] ..... G09G 5/00

(52) U.S. Cl. ..... 345/100; 345/30; 345/55; 345/93; 345/204; 345/211; 345/212; 345/213; 345/214; 345/215; 330/96; 330/98; 330/123; 330/127; 330/199; 330/250; 330/253

(58) Field of Search ..... 345/30, 40, 51, 345/52, 55, 56, 61, 68, 87–106, 209–215, 345/204; 330/96, 98, 123, 127, 199, 250, 330/253

(56) References Cited

U.S. PATENT DOCUMENTS

| | | | | |
|---|---|---|---|---|
| 5,598,180 | A * | 1/1997 | Suzuki et al. | 345/100 |
| 6,166,725 | A * | 12/2000 | Isami et al. | 345/209 |
| 6,256,025 | B1 * | 7/2001 | Imai et al. | 345/211 |
| 6,501,467 | B2 * | 12/2002 | Miyazaki | 345/210 |
| 2002/0008686 | A1 * | 1/2002 | Kumada et al. | 345/94 |

* cited by examiner

*Primary Examiner*—Sumati Lefkowitz
*Assistant Examiner*—Alexander S. Beck
(74) *Attorney, Agent, or Firm*—Brett A. Hertzberg; Merchant & Gould PC

(57) ABSTRACT

A column driver for a graphics display has reduced power consumption by sharing power between upper and lower column amplifiers. The upper column amplifier operates over an upper supply range, while the lower column amplifier operates over a lower supply range. The upper and lower amplifiers have the substantially the same quiescent operating current such that the total operating current for the column drivers in the graphics display is reduced by a factor of two. Each column amplifier can be driven over half of the power-supply range such that lower voltage amplifiers may be employed for the column driver amplifiers.

22 Claims, 4 Drawing Sheets

STACKED AMPLIFIER ARRANGEMENT FOR GRAPHICS DISPLAYS

FIELD OF THE INVENTION

The present invention is generally related to column drivers for a graphics display. More particularly, the present invention relates to a column driver that has reduced power consumption by sharing power between odd and even column amplifiers.

BACKGROUND OF THE INVENTION

A liquid crystal display (LCD) system is illustrated in FIG. 1. The LCD display system includes an LCD array that is organized according to rows and columns. A timing and control block receives video data and generates the necessary timing signals to selectively activate pixels in the LCD system. The timing and control signals activate a pixel by enabling a column driver and a row selector. Thin film transistor (TFT) type displays have a transistor array that is placed on top of liquid crystal array to operate as the row selectors.

SUMMARY OF THE INVENTION

Briefly stated, the present invention is related to column drivers for a graphics display that have reduced power consumption by sharing power between upper and lower column amplifiers. The upper column amplifier operates over an upper supply range, while the lower column amplifier operates over a lower supply range. The upper and lower amplifiers have the substantially the same quiescent operating current such that the total operating current for the column drivers in the graphics display is reduced by a factor of two. Each column amplifier can be driven over half of the power-supply range such that lower voltage amplifiers may be employed for the column drivers in the present invention.

A more complete appreciation of the present invention and its improvements can be obtained by reference to the accompanying drawings, which are briefly summarized below, the following detail description of presently preferred embodiments of the invention, and the appended claims.

DETAILED DESCRIPTION OF THE PREFERRED EMBODIMENT

Throughout the specification, and in the claims, the term "connected" means a direct electrical connection between the things that are connected, without any intermediate devices. The term "coupled" means either a direct electrical connection between the things that are connected, or an indirect connection through one or more passive or active intermediary devices. The term "circuit" means either a single component or a multiplicity of components, either active or passive, that are coupled together to provide a desired function.

The present invention is generally related to column drivers for a graphics display. More particularly, the present invention relates to column drivers that have reduced power consumption by sharing power between odd and even column driver amplifiers. The quiescent bias currents for the column drivers are reduced by a factor of two using the sharing technique of the present invention. Each column amplifier can be driven over half of the power-supply range such that lower voltage amplifiers may be employed for the column drivers in the present invention.

Graphics displays such as LCDs are organized according to rows and columns. A pixel in the LCD display is addressed by activating a column driver and a row selector. Separate buffer amplifiers (column drivers) are employed to drive each respective column of the LCD. Thus, a typical LCD requires hundreds of buffer amplifiers to drive all of the columns in the display. Each of the buffer amplifiers is generally required to drive a rail-to-rail signal to the respective one of the columns in the LCD.

Color LCDs typically include multiple color planes (e.g., RGB). Each pixel address typically includes a separate pixel for each color plane. Pixels in the LCD are arranged as charge storage elements that are represented as capacitors. Each row selector operates as a switch that couples the output of a column driver to pixel in the LCD array. The charge stored in the pixel is an analog quantity that determines the brightness associated with the pixel. For color pixel arrays, the color associated with a selected pixel is determined by the charge stored in each of the pixels associated with the color planes. A typical color LCD also requires hundreds of buffer amplifiers to drive all of the columns in the display.

Figure 1:
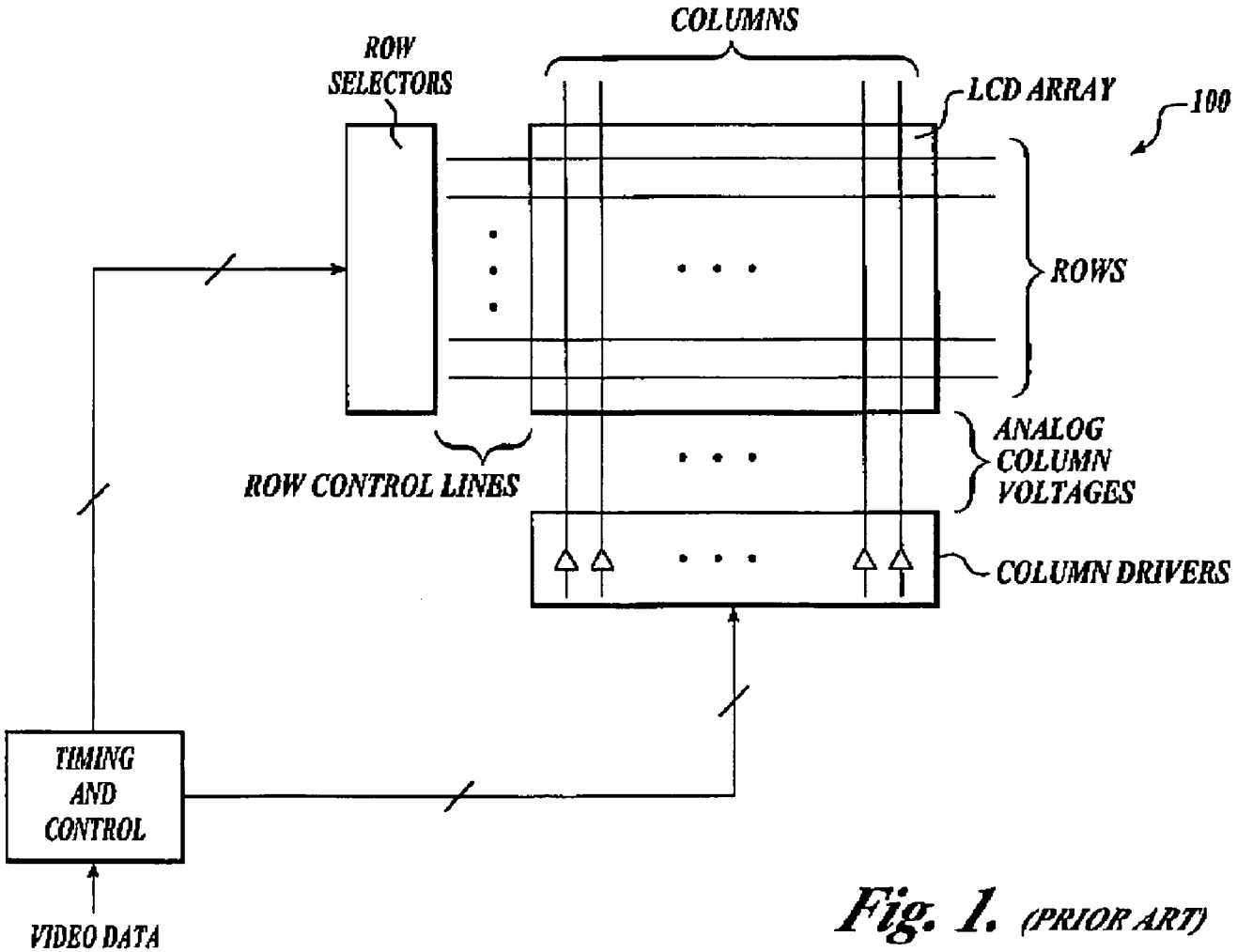
Fig. 1. (PRIOR ART)
FIG. 1 is a schematic diagram of a conventional LCD system.
Figure 2:
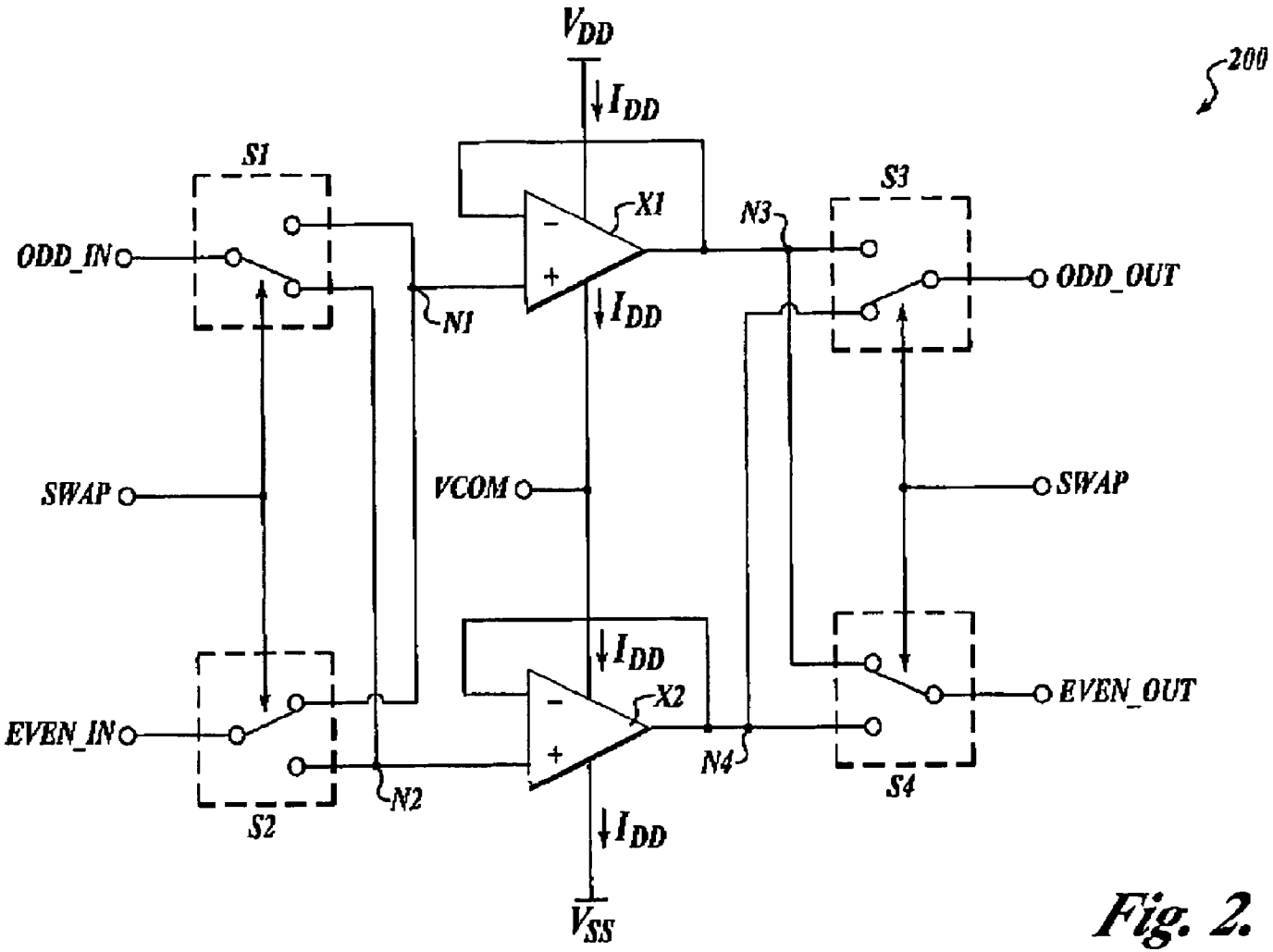
FIG. 2 is a schematic diagram of a stacked amplifier column driver circuit.

FIG. 2 is a schematic diagram (200) of an example stacked amplifier column driver circuit that is arranged in accordance with the present invention. The stacked amplifier column driver circuit includes an upper amplifier circuit (X1), a lower amplifier circuit (X2), and four switching circuit (S1–S4).

The upper amplifier circuit (X1) includes a non-inverting input terminal that is coupled to a first node (N1), an inverting input terminal that is coupled to a third node (N3), and an output terminal that is also coupled to the third node (N3). The lower amplifier circuit (X2) includes a non-inverting input terminal that is coupled to a second node (N3), an inverting input terminal that is coupled to a fourth node (N4), and an output terminal that is also coupled to the fourth node (N4). Switching circuit S1 is coupled to an odd column input terminal (ODD_IN), the first node (N1), the second node (N2), and a control signal (SWAP). Switching circuit S2 is coupled to an even column input terminal (EVEN_IN), the first node (N1), the second node (N2), and the control signal (SWAP). Switching circuit S3 is coupled to an odd column output terminal (ODD_OUT), the third node (N3), the fourth node (N4), and the control signal (SWAP). Switching circuit S4 is coupled to an even column output terminal (EVEN_OUT), the third node (N3), the fourth node (N4), and the control signal (SWAP).

The upper amplifier circuit (X1) also includes a high supply terminal that is coupled to VDD, and a low supply terminal that is coupled to VCOM. The lower amplifier circuit (X2) includes a high supply terminal that is coupled to VCOM, and a low supply terminal that is coupled to VSS. Both amplifier circuits X1 and X2 share a common supply level that corresponds to VCOM. In one example, VSS corresponds to 0V and VCOM corresponds to VDD/2. In another example, VCOM corresponds to 0V and VDD and VSS are equidistant from 0V. Generally, VCOM corresponds to a middle supply voltage that corresponds to [(VDD−VSS)/2+VSS].

Switching circuit S1 is arranged to couple the odd input terminal (ODD_IN) to either node N1 when the control signal (SWAP) corresponds to a first logic level, or node N2 when the control signal (SWAP) corresponds to a second logic level. The second logic level corresponds to an inverse of the first logic level. Similarly, switching circuit S2 is arranged to couple the even input terminal (EVEN_IN) to either node N2 when the control signal (SWAP) corresponds to the first logic level, or node N1 when the control signal corresponds to the second logic level. Switching circuit S3 is arranged to couple the odd output terminal (ODD_OUT) to either node N3 when the control signal (SWAP) corresponds to the first logic level, or node N4 when the control signal (SWAP) corresponds to the second logic level. Similarly, switching circuit S4 is arranged to couple the even output terminal (EVEN_OUT) to either node N4 when the control signal (SWAP) corresponds to the first logic level, or node N3 when the control signal corresponds to the second logic level.

Pixels in the LCD are susceptible to damage when a DC voltage is maintained across the LCD for long periods of time. The liquid crystal damage is a result of charge migration across the liquid crystal, possibly de-ionizing the material. The result of the charge migration is that the LCD material will stick to the surfaces and cause image retention issues such as a sticking image. To prevent damaging the LCD material, the polarity of the signal applied to the LCD pixel is periodically reversed, typically every frame.

An example LCD display system employs an alternating pixel pattern referred to as pixel inversion. In a pixel inversion system, each LCD column must be operated about a common voltage such that the output for each odd column is operated in an opposite range (e.g., from VDD to VDD/2) as the output for the even columns (e.g., from VDD/2 to VSS).

Each of the amplifier circuits (X1, X2) operates over half of the total power supply range (e.g., VCOM−VDD and VSS−VCOM). The upper and lower amplifier circuits need not provide outputs levels that swing over the entire supply range (VSS through VDD). Each of the amplifier circuits can be optimized to operate over the limited supply range. For example, the differential input transistors in the upper amplifier circuit can be implemented as n-type devices that operate over the upper supply range, while the differential input transistors in the lower amplifier circuit can be implemented as p-type devices that operate over the lower supply range. The complexity of the amplifier circuits is simplified since the amplifiers need not operate over the full supply levels.

Since the amplifier circuits only operate over half of the supply range, the amplifier circuits can employ devices (e.g., transistors, diodes, etc.) that have breakdown voltages that are less than the full supply voltage without the need for additional protection devices. Since additional protection devices would add parasitic capacitances to the circuits, additional protection devices would degrade the speed of the amplifier circuits. The amplifier circuits of the present invention may have increased operating speeds by elimination of the additional protection devices.

An example display may have a resolution of 1024×768 pixels, requiring 1024 column driver amplifier circuits for a monochrome display, and 3072 column drives are required when there are three color planes. Since the number of column driver amplifier circuits is very large, any savings in power consumption for a column driver cell may have dramatic results in total power consumption. The limited range of operation for the amplifiers will result in a reduction in overall power that is consumed by each column drivers. The upper amplifier circuit (X1) and the lower amplifier circuit (X2) may be arranged to have matched quiescent currents (e.g., $I_{DD}$) such that the total power consumption by adjacent column drivers is halved.

Figure 3:
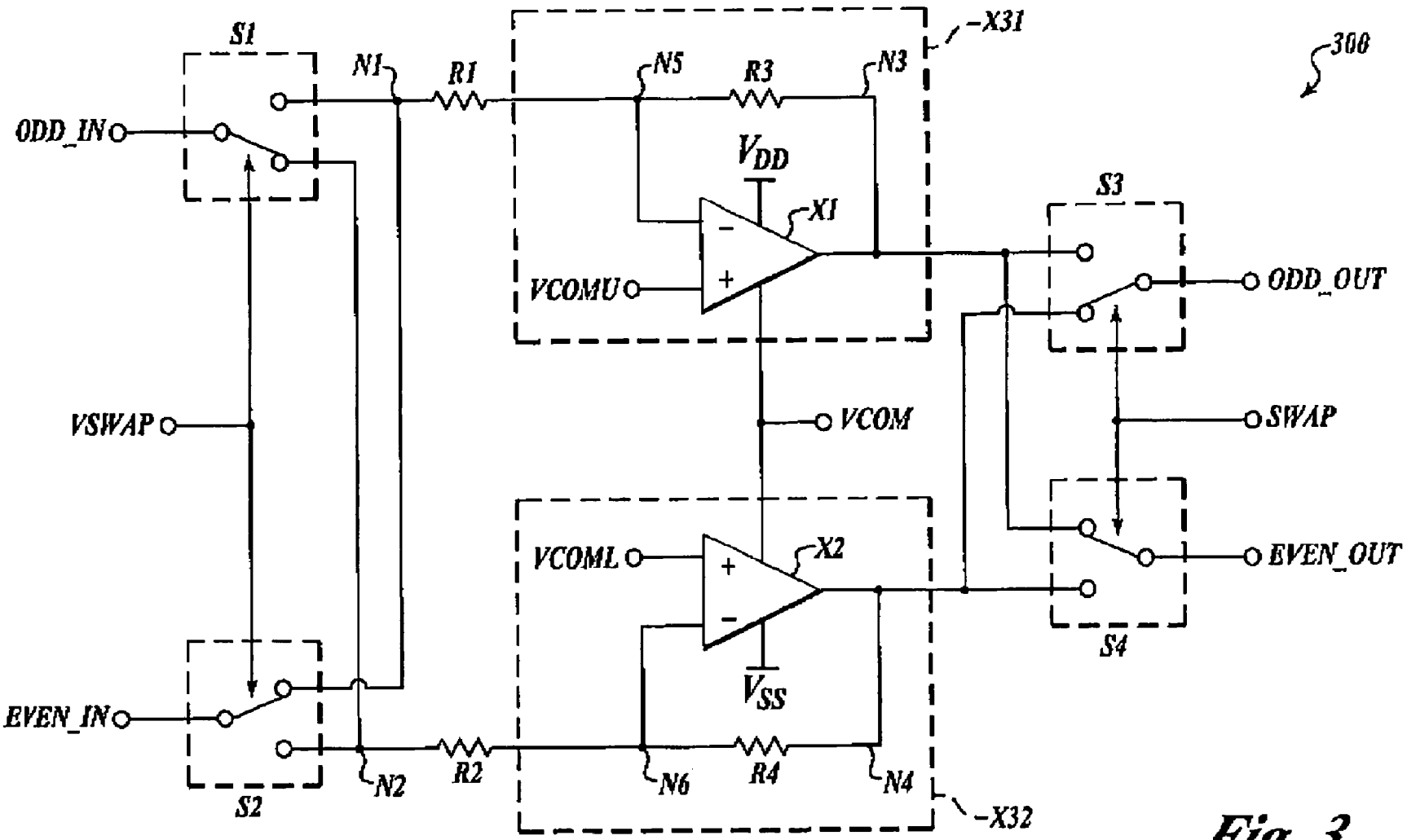
FIG. 3 is a schematic diagram of another stacked amplifier column driver circuit.

FIG. 3 is a schematic diagram (300) of another example stacked amplifier column driver circuit that is arranged in accordance with the present invention. The stacked amplifier column driver circuit includes an upper amplifier circuit (X31), a lower amplifier circuit (X32), and four switching circuit (S1–S4). The stacked amplifier column driver circuit that is illustrated in FIG. 3 is similar to the stacked amplifier column driver circuit that is illustrated in FIG. 2, and like components and nodes are labeled identically. However, the upper and lower amplifier circuits (X31, X32) are configured as inverting amplifiers as will be described below.

The upper amplifier circuit (X31) includes two resistors (R1, R3), and an amplifier circuit (X1). Resistor R1 is coupled between node N1 and node N5. Resistor R3 is coupled between node N5 and node N3. Amplifier circuit X1 includes a non-inverting input terminal that is coupled to an upper common voltage (VCOMU), an inverting input terminal that is coupled to the node N5, and an output terminal that is coupled to node N3. The lower amplifier circuit (X32) includes two resistors (R2, R4), and an amplifier circuit (X2). Resistor R2 is coupled between node N2 and node N6. Resistor R4 is coupled between node N6 and node N4. Amplifier circuit X2 includes a non-inverting input terminal of that is coupled to a lower common voltage (VCOML), an inverting input terminal that is coupled to node N6, and an output terminal that is coupled to the node N4.

Similar to the schematic illustrated in FIG. 2, the upper amplifier circuit (X31) includes a high supply terminal that is coupled to VDD, and a low supply terminal that is coupled to VCOM. The lower amplifier circuit (X32) includes a high supply terminal that is coupled to VCOM, and a low supply terminal that is coupled to VSS. Both amplifier circuits X1 and X2 share a common supply level (VCOM), which is a half supply voltage that corresponds to [(VDD−VSS)/2+VSS].

Amplifier circuit X1 is arranged to operate as an inverting amplifier circuit that has a gain that is determined by resistors R1 and R3. The upper amplifier circuit (X31) also includes an upper common voltage (VCOMU) that is a middle-supply for the range from VCOM to VDD. In other words, VCOMU is determined by VCOM and VDD as: VCOMU=VCOM+(VDD−VCOM)/2. In operation, the inverting input of amplifier circuit X1 will have the same DC level as the non-inverting input such that the DC voltage at node N5 will be VCOMU. Amplifier X1 need not operate over a rail-to-rail input range when configured as an inverting amplifier, and instead has a limited operating range that is centered on VCOMU.

Amplifier circuit X2 is arranged to operate as an inverting amplifier circuit that has a gain that is determined by resistors R2 and R4. The lower amplifier circuit (X32) also includes a lower common voltage (VCOML) that is a middle-supply for the range from VSS to VCOM. In other words, VCOML is determined by VCOM and VSS as: VCOML=VSS+(VCOM−VSS)/2. In operation, the inverting input of amplifier circuit X2 will have the same DC level as the non-inverting input such that the DC voltage at node N6 will be VCOML. Amplifier X2 need not operate over a rail-to-rail input range when configured as an inverting amplifier, and instead has a limited operating range that is centered on VCOML.

Figure 4:
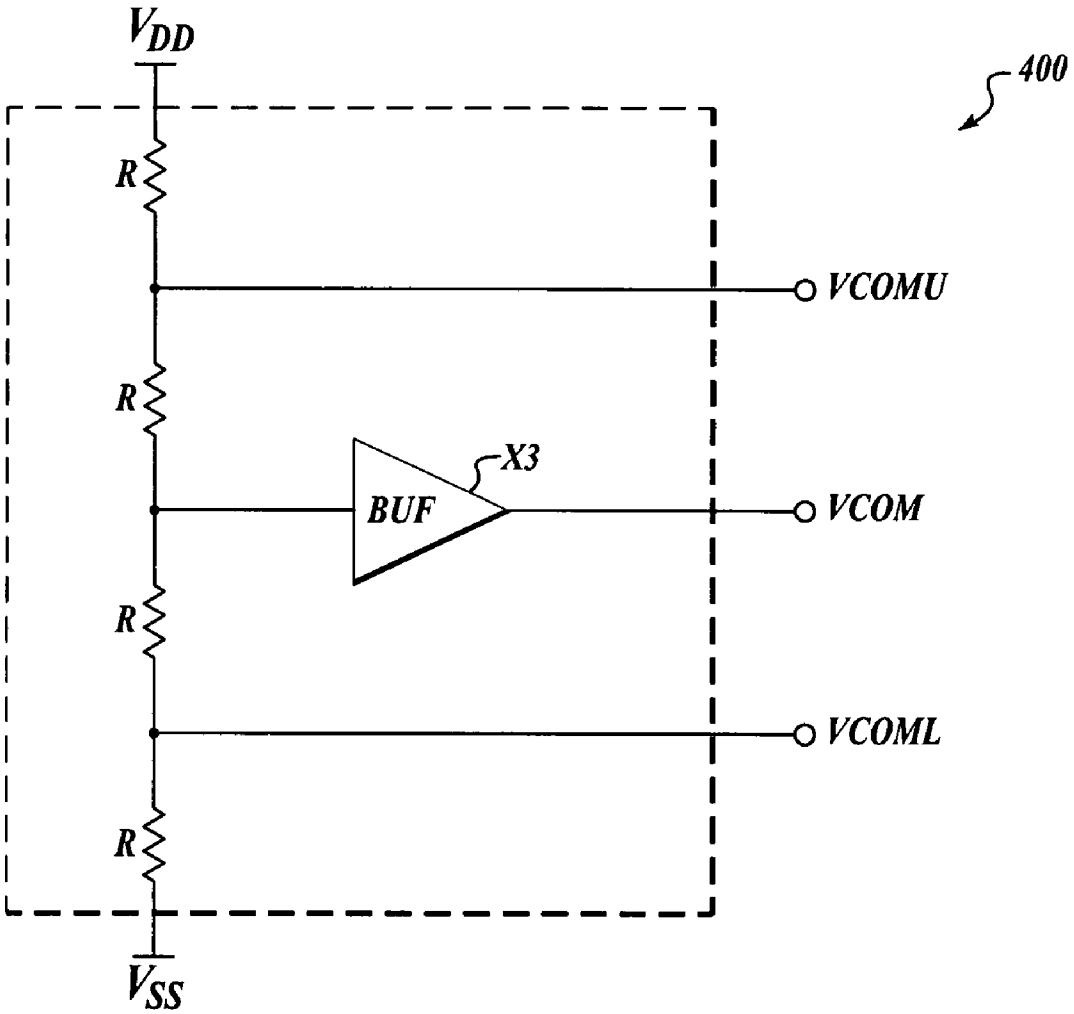
FIG. 4 is a schematic diagram of a voltage reference, arranged in accordance with the present invention.

A schematic of an example voltage reference circuit (400) that is arranged in accordance with the present invention is illustrated in FIG. 4. The voltage reference includes four equal value resistors (R) and a buffer circuit (X3). The resistors (R) are arranged as a voltage divider network that is coupled between the upper power supply (VDD) and the lower power supply (VSS). The buffer circuit (X3) is coupled to the center tap of the voltage divider such that VCOM is half way between VDD and VSS, or VCOM=VSS+(VDD−VSS)/2. VCOMU is coupled to the top tap of the resistor divider such that VCOMU is half way between VCOM and VDD, or VCOMU=VCOM+(VDD−VCOM)/2. VCOML is coupled to the VCOM, or VCOML=VSS+(VCOM−VSS)/2. The buffer circuit is provided such that currents from the amplifier circuits (see FIGS. 2 and 3) do not change the voltage associated with VCOM.

Voltage reference circuit 400 is an example of one possible voltage reference that may be employed by the amplifier circuits illustrated in FIGS. 2 and 4. However, any other appropriate voltage reference circuit may be employed in place of the voltage reference circuit that is illustrated in FIG. 4.

The switching circuits employed in FIGS. 2 and 3 can be any circuit that is arranged to provide a switching function. In one example, the switching circuits are field effect transistors (FETs) such as metal-oxide semiconductor (MOS) devices. However, the same circuit configuration is equally applicable for bipolar junction transistors (BJTs), as well as others. Other example circuits that perform the switching functions described above are considered within the scope of the present invention.

The amplifier and buffer circuits employed in FIGS. 2 through 4 can be any circuit that is arranged to provide an amplifier function, where the upper and lower amplifiers are matched in overall quiescent current. Each of the amplifier circuits is a differential amplifier that includes a differential pair input stage. In one example, the upper amplifier circuit has N-type transistors in the differential pair input stage and the lower amplifier circuit has P-type transistors. The transistors can be field effect transistors (FETs) such as metal-oxide semiconductor (MOS) devices. However, the same circuit configuration is equally applicable for bipolar junction transistors (BJTs), as well as others. Other example circuits that perform the amplifying/buffering functions described above are considered within the scope of the present invention.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A column driver circuit for a graphics display, comprising:

an upper amplifier circuit that includes an upper supply terminal that is coupled to an upper power supply, and a lower supply terminal that is coupled to a common power supply; and a lower amplifier circuit that includes an upper supply terminal that is coupled to the common power supply, and a lower supply terminal that is coupled to a lower power supply, wherein the upper amplifier circuit is configured to drive a column of the graphics display over an upper supply range and the lower amplifier circuit is configured to drive another column of the graphics display over the lower supply range, wherein the upper and lower amplifier circuits are arranged to share a common quiescent operating current.

2. The column driver circuit as in claim 1, wherein the upper and lower amplifier circuits are configured as unity gain buffers.

3. The column driver circuit as in claim 1, wherein the upper and lower amplifier circuits are configured as inverting amplifiers.

4. The column driver circuit as in claim 1, wherein the upper amplifier circuit is optimized for operation over an upper power supply range that is bounded by the common power supply and the upper power supply, and wherein the lower amplifier circuit is optimized for operation over a lower power supply range that is bounded by the lower power supply and the upper power supply.

5. The column driver circuit as in claim 1, wherein the column and the other column are adjacent columns in the graphics display.

6. The column driver circuit of claim 1, further comprising:

a first switching circuit that is coupled to a column input signal, an input of the upper amplifier circuit, and another input of the lower amplifier circuit, wherein the first switching circuit is arranged selectively couple the column input signal to one of the input and the other input in response to a control signal; and a second switching circuit that is coupled to another column input signal, the input of the upper amplifier circuit, and other input of the lower amplifier circuit, and wherein the second switching circuit is arranged to selectively couple the other column input signal to another of the input and the other input in response to the control signal.

7. The column driver circuit of claim 6, wherein the column input signal corresponds to an odd column of the graphics display and the other column input signal corresponds to an even column of the graphics display.

8. The column driver circuit of claim 1, further comprising:

a first switching circuit that is coupled to the column, an output of the upper amplifier circuit, and another output of the lower amplifier circuit, wherein the first switching circuit is arranged selectively couple the column to one of the output and the other output in response to a control signal; and a second switching circuit that is coupled to the other column, the output of the upper amplifier circuit, and other output of the lower amplifier circuit, wherein the second switching circuit is arranged to selectively couple the other column input signal to another of the output and the other output in response to the control signal.

9. The column driver circuit of claim 8, wherein the column corresponds to an odd column of the graphics display and the other column corresponds to an even column of the graphics display.

10. The column driver circuit of claim 1, further comprising:

a first switching circuit that is coupled to a column input signal, an input of the upper amplifier circuit, and another input of the lower amplifier circuit, wherein the first switching circuit is arranged selectively couple the column input signal to one of the input and the other input in response to a control signal;

a second switching circuit that is coupled to another column input signal, the input of the upper amplifier circuit, and other input of the lower amplifier circuit, and wherein the second switching circuit is arranged to selectively couple the other column input signal to another of the input and the other input in response to the control signal;

a third switching circuit that is coupled to the column, an output of the upper amplifier circuit, and another output of the lower amplifier circuit, wherein the third switching circuit is arranged selectively couple the column to one of the output and the other output in response to a control signal; and a fourth switching circuit that is coupled to the other column, the output of the upper amplifier circuit, and other output of the lower amplifier circuit, wherein the fourth switching circuit is arranged to selectively couple the other column input signal to another of the output and the other output in response to the control signal.

11. The column driver circuit of claim 10, wherein the column input signal and the column are associated with an odd column of the graphics display, and the other column input signal and the other column are associated with an even column of the graphics display.

12. The column driver circuit of claim 1, wherein the upper amplifier circuit and the lower amplifier circuit are arranged to have substantially matched quiescent currents such that a total power consumption by two adjacent column driver circuits is reduced by about fifty percent.

13. The column driver circuit of claim 1, wherein the upper amplifier circuit and the lower amplifier circuit are arranged to operate over the upper supply range and the lower supply range, respectively, so that at least one protection device for the upper amplifier circuit and at least another protection device for the lower amplifier circuit against breakdown voltage is eliminated.

14. The column driver circuit of claim 13, wherein the upper supply range and the lower supply range are about fifty percent of a total supply range.

15. The column driver circuit of claim 13, wherein the upper amplifier circuit and the lower amplifier circuit without the at least one protection device and the at least other protection device are arranged to operate at a relatively higher speed.

16. The column driver circuit of claim 1, wherein the upper amplifier circuit and the lower amplifier circuit each comprise at least one of: a Bipolar Junction Transistor (BJT), a Metal-Semiconductor Field Effect Transistor (MESFET), and a Metal-Oxide Field Effect Transistor (MOSFET).

17. The column driver circuit of claim 1, wherein the upper amplifier circuit is arranged to receive one of an odd column signal and an even column signal, and wherein the lower amplifier circuit is arranged to receive the other of the odd column signal and the even column signal.

18. The column driver circuit of claim 1, wherein the upper amplifier circuit and the lower amplifier circuit are arranged to simultaneously drive the column of the graphics display and the other column of the graphics display, respectively.

19. A column driver circuit for a graphics display, comprising:

a first means for buffering that is arranged to provide a buffered signal that is in an upper supply range that is bounded by a common power supply and an upper power supply;

a second means for buffering that is arranged to provide another buffered signal that is in a lower supply range that is bounded by a lower power supply and the common power supply, wherein the first means for buffering and the second means for buffering are configured to share quiescent operating current;

a first means for coupling that is arranged to couple a column input signal to one of the first means for buffering and the second means for buffering in response to a control signal;

a second means for coupling that is arranged to couple another column input signal to the other of the first means for buffering and the second means for buffering in response to the control signal;

a third means for coupling that is arranged to couple the buffered signal to one of a column of the graphics display and another column of the graphics display in response to the control signal; and a fourth means for coupling that is arranged to couple the other buffered signal to the other of the column of the graphics display and the other column of the graphics display in response to the control signal.

20. A column driver circuit for a graphics display, comprising:

an upper amplifier circuit that includes an upper supply terminal that is coupled to an upper power supply, and a lower supply terminal that is coupled to a common power supply;

a lower amplifier circuit that includes an upper supply terminal that is coupled to the common power supply, and a lower supply terminal that is coupled to a lower power supply, wherein the upper amplifier circuit is configured to drive a column of the graphics display over an upper supply range and the lower amplifier circuit is configured to drive another column of the graphics display over the lower supply range, wherein the upper and lower amplifier circuits are arranged to share a common quiescent operating current;

a first switching circuit that is coupled to a column input signal, an input of the upper amplifier circuit, and another input of the lower amplifier circuit, wherein the first switching circuit is arranged selectively couple the column input signal to one of the input and the other input in response to a control signal;

a second switching circuit that is coupled to another column input signal, the input of the upper amplifier circuit, and other input of the lower amplifier circuit, and wherein the second switching circuit is arranged to selectively couple the other column input signal to another of the input and the other input in response to the control signal;

a third switching circuit that is coupled to the column, an output of the upper amplifier circuit, and another output of the lower amplifier circuit, wherein the third switching circuit is arranged selectively couple the column to one of the output and the other output in response to a control signal; and a fourth switching circuit that is coupled to the other column, the output of the upper amplifier circuit, and other output of the lower amplifier circuit, wherein the fourth switching circuit is arranged to selectively couple the other column input signal to another of the output and the other output in response to the control signal.

21. A circuit for driving a pair of columns of a graphics display, wherein the pair of columns includes a first column and a second column, the circuit comprising:

a switching circuit that is arranged to: receive a first input signal and a second input signal, provide a first drive signal in response to one of the first input signal and the second input signal, and provide a second drive signal in response to the other of the first input signal and the second input signal;

a first amplifier circuit that is arranged to drive the first column of the graphics display in response to the first drive signal; and a second amplifier circuit is arranged to drive the second column of the graphics display based in response to the second drive signal, wherein the first amplifier circuit and the second amplifier circuit are arranged such that the first column and the second column of the graphics display are concurrently driven by a respective one of the first amplifier circuit and the second amplifier circuit, and wherein the first amplifier circuit and the second amplifier circuit are commonly biased.

22. A circuit for driving a pair of columns of a graphics display, wherein the pair of columns includes a first column and a second column, the circuit comprising:

a first switching circuit that is arranged to: receive a first input signal and a second input signal, provide a first drive signal in response to one of the first input signal and the second input signal, and provide a second drive signal in response to the other of the first input signal and the second input signal;

a first amplifier circuit that is arranged to provide a first output signal in response to the first drive signal;

a second amplifier circuit is arranged to provide a second output signal in response to the second drive signal, wherein the first amplifier circuit and the second amplifier circuit are commonly biased; and a second switching circuit that is arranged to provide one of the first output signal and the second output signal to the first column of the graphics display, and provide the other of the first output signal and the second output signal to the second column of the graphics display such that the first amplifier circuit and the second amplifier circuit are concurrently driving a respective one of the first and second columns.

* * * * *